US010080416B2

(12) United States Patent
Caulier et al.

(10) Patent No.: US 10,080,416 B2
(45) Date of Patent: Sep. 25, 2018

(54) PACKAGING AND APPLICATION DEVICE

(71) Applicant: L'OREAL, Paris (FR)

(72) Inventors: Eric Caulier, Maignelay (FR); Lionel Drugeon, La Garennes Colombes (FR); Philippe Goulinet, Asnieres sur Seine (FR)

(73) Assignee: L'OREAL, Paris (FR)

( * ) Notice: Subject to any disclaimer, the term of this patent is extended or adjusted under 35 U.S.C. 154(b) by 61 days.

(21) Appl. No.: 15/106,554

(22) PCT Filed: Dec. 18, 2014

(86) PCT No.: PCT/IB2014/067061

§ 371 (c)(1),
(2) Date: Jun. 20, 2016

(87) PCT Pub. No.: WO2015/092728

PCT Pub. Date: Jun. 25, 2015

(65) Prior Publication Data

US 2016/0331104 A1 Nov. 17, 2016

(30) Foreign Application Priority Data

Dec. 20, 2013 (FR) ..... 13 63323

(51) Int. Cl.
*A45D 40/26* (2006.01)
*B65D 1/02* (2006.01)

(52) U.S. Cl.
CPC ..... *A45D 40/267* (2013.01); *B65D 1/023* (2013.01)

(58) Field of Classification Search
CPC .. A45D 40/265; A45D 40/267; A45D 34/045; A45D 34/046; A46B 2200/1053
(Continued)

(56) References Cited

U.S. PATENT DOCUMENTS 5,490,737 A 2/1996 Gueret
7,476,004 B2 1/2009 Chan
(Continued)

FOREIGN PATENT DOCUMENTS

DE 19642720 A1 4/1998
EP 1614367 A1 1/2006
FR 2826246 A1 12/2002

OTHER PUBLICATIONS

Mar. 11, 2015 International Search Report issued in International Patent Application No. PCT/IB2014/067061.
(Continued)

*Primary Examiner* — David Walczak
*Assistant Examiner* — Joshua Wiljanen
(74) *Attorney, Agent, or Firm* — Oliff PLC

(57) ABSTRACT

Device for packaging and applying a product, especially a cosmetic product, comprising a container (10) containing the product to be applied and an applicator comprising a wand provided at one end with an application member, the assembly formed by the wand and the application member extending along a non-rectilinear longitudinal axis, and a wiping member (30) borne by the container (10) in order to wipe the wand and the application member when the latter is removed from the container, the wiping member (30) comprising a tubular mounting skirt (31), in contact with a wall (12) of the container, and a wiping lip (71, 72) comprising a tubular-shaped portion (71) having a length (k) greater than or equal to its internal diameter (Dint), extending axially beyond the mounting skirt (31) towards the bottom of the container.

20 Claims, 1 Drawing Sheet

(58) Field of Classification Search
USPC ..... 401/118, 121–130
See application file for complete search history.

(56) References Cited

U.S. PATENT DOCUMENTS

| | | | | |
|---|---|---|---|---|
| 8,998,522 | B2 * | 4/2015 | Gueret | A45D 34/046 401/126 |
| 2002/0195117 | A1 * | 12/2002 | Bailly | A45D 8/06 132/200 |
| 2012/0026355 | A1 | 2/2012 | Ryu | |

OTHER PUBLICATIONS

Mar. 11, 2015 Written Opinion issued in International Patent Application No. PCT/IB2014/067061.

* cited by examiner

PACKAGING AND APPLICATION DEVICE

TECHNICAL FIELD

The present invention relates to devices for packaging and applying a product, especially a cosmetic product, for example mascara or a lip gloss, comprising a container containing the product to be applied and an applicator comprising an application member at the end of a wand. A wiping member is borne by the container in order to wipe the wand of the applicator and the application member when the latter is removed from the container.

BACKGROUND

Many wiping members have already been proposed, in order to adapt the wiping as best possible to the nature of the application member and/or to the shape of the wand. Indeed, it may be desirable not to wipe the application member too vigourously as it is liable to reduce the autonomy of the applicator and/or render makeup application more difficult.

U.S. Pat. No. 7,476,004 describes a wiping member comprising a tubular mounting skirt in contact with a wall of the container and a tubular-shaped wiping lip that extends axially beyond the mounting skirt towards the bottom of the container. This skirt is made with recesses so as to orient particles contained in the product, such as glitter, during passage of the wiping member. The application member is borne by a wand having a rectilinear longitudinal axis.

FR 2826246 discloses a wiping member comprising a conical-shaped wiping lip and a tubular part that extends the mounting skirt underneath the wiping lip and around the latter. The lower end of the wiping member is defined by this tubular part.

U.S. Pat. No. 5,490,737 describes a wiping member comprising a flocked wiping lip that extends the mounting skirt. The application member is borne by a wand having a rectilinear longitudinal axis.

US 2012/026355 discloses a wiping member provided with a flexible wiping lip bearing spikes on its outer surface. The application member is borne by a wand having a rectilinear longitudinal axis.

DE 196 42 720 A1 discloses a wiping member comprising a wiping lip. Only one edge of the wiping lip comes into contact with the application member during wiping.

There is a need to further perfect the wiping members and in particular to have a wiping member capable of satisfactorily wiping an applicator despite a complex geometry of the application member and/or of the wand, for example the presence of a wand having a non-rectilinear longitudinal axis.

SUMMARY

The invention meets this need by virtue of a device for packaging and applying a product, especially a cosmetic product, comprising a container containing the product and an applicator comprising a wand, provided at one end with an application member, the assembly formed by the wand and the application member having a non-rectilinear longitudinal axis, and a wiping member borne by the container in order to wipe the wand and the application member when the latter is removed from the container, the wiping member comprising a tubular mounting skirt in contact with a wall of the container and a tubular-shaped wiping lip having a length greater than or equal to its internal diameter, extending axially beyond the mounting skirt towards the bottom of the container.

The wand may have a non-rectilinear longitudinal axis.

As a variant, or additionally, the application member is bent relative to the wand and/or has a curved longitudinal axis.

The wiping lip, due to its tubular shape and its length, is capable of wiping a non-rectilinear wand more effectively.

The wiping thus advantageously takes place along the tubular portion, the latter preferably being adapted to come into contact, over substantially all of its length, with the wand. Thus, the tubular portion of the wiping lip may have an internal diameter which preferably departs little from a nominal value that corresponds substantially, preferably, to the diameter of the wand.

Preferably, the wiping lip is connected to the mounting skirt by a narrowed intermediate part.

The presence of the narrowed part gives increased flexibility to the wiping member and enables it to more easily take on the orientation necessary for the passage of the wand and/or of the application member.

Preferably, the container is made in a conventional manner, that is to say that it comprises a neck in which the mounting skirt is engaged, the latter preferably being snap-fastened to the neck. The wiping member may comprise a flange for attachment to the container, in particular underneath a shoulder of the container at the base of the neck.

The product contained in the container may be mascara, containing for example an iron oxide.

The mounting skirt may be narrowed over a portion of its length above the attachment flange, in particular due to the presence of an annular groove formed on the radially outer surface of the mounting skirt.

The narrowed part may be delimited on the outer side by an annular groove. The narrowed part may have a minimum thickness of between 0.4 mm and 1 mm.

The wiping member may have a shoulder at the base of the mounting skirt, on the inner surface thereof.

The wiping lip is preferably continuous over its entire height.

The wiping lip is preferably unchamfered at its lower end.

Preferably, the wiping lip has a circular internal cross section. As a variant, the wiping lip has a non-circular internal cross section. In this case, the internal diameter $D_{int}$ of the wiping lip should be understood to mean the diameter of the largest circle inscribed in its smallest internal cross section.

Preferably, the internal diameter of the wiping lip is substantially constant over a distance at least equal to $D_{int}$, better still double or even triple $D_{int}$. The expression "substantially constant" should be understood to mean that the internal diameter is equal to $D_{int}$ to within 10%, that is to say is between $D_{int}$ and 1.1 $D_{int}$.

The smallest internal diameter $D_{int}$ may be the diameter at the lower end of the wiping lip.

The lower end of the wiping lip preferably also defines the lower end of the wiping member.

BRIEF DESCRIPTION OF THE DRAWINGS

The invention may be better understood from reading the following detailed description of non-limiting implementation examples thereof and from examining the appended drawing, in which.

DETAILED DESCRIPTION OF PREFERRED EMBODIMENTS

Figure 1:
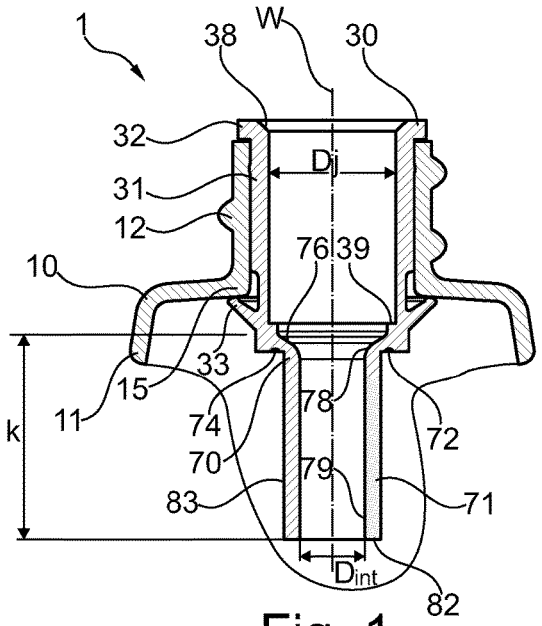
FIG. 1 schematically shows, in partial longitudinal cross section, a packaging and application device according to the invention.
Figure 5:
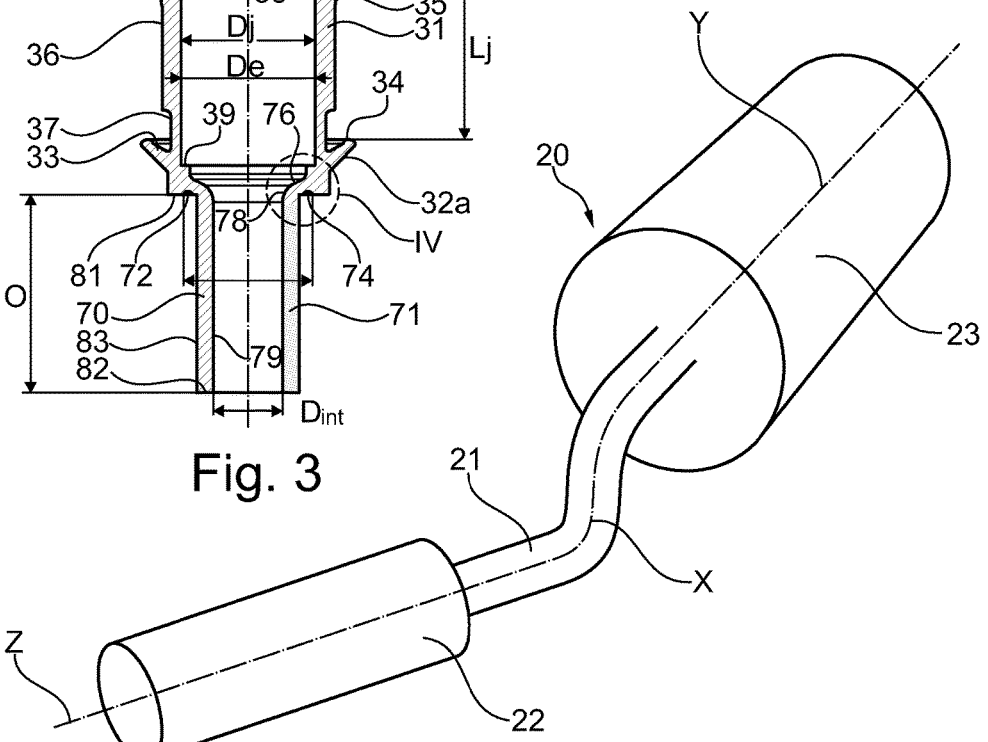
FIG. 5 shows an example of an applicator that can be used together with the container and the wiping member from FIG. 1.

The packaging and application device 1 shown in FIG. 1 comprises a container 10 intended to receive an applicator 20 as illustrated in FIG. 5, that may be attached to the container when not in use.

The container 10 comprises a body 11 surmounted by a neck 12 to which a wiping member 30 in accordance with the invention is attached.

A product is contained in the container, preferably a cosmetic product to be applied to the eyelashes and/or the eyebrows, especially mascara, or a product to be applied to the lips.

The applicator 20 comprises a wand 21 provided at one end with an applicator member 22 and at the other end with a gripping member 23 that likewise forms a cap for closing the container.

The neck 12 may be threaded and the gripping member 23 may be attached to the neck 12 by screwing.

The application member 22 may be of any type, for example being a mascara brush produced by injection moulding of plastic, or a brush having a twisted metal core.

The wand 21 may have a non-rectilinear longitudinal axis X, in particular that extends in the three spatial directions.

In particular, as illustrated, the wand 21 may have at least two bends about non-coplanar axes.

The wand 21 may be produced from an elastomeric material, so as to be able to deform during extraction from the container, for example from a thermoplastic elastomer.

The angle between the respective longitudinal axes Y and Z of the gripping part 23 and of the application member 22 may be greater than or equal to 25°.

The radii of curvature of the two bends may be different, it being possible for the radius of curvature of the first bend, closer to the gripping member 23, to be greater than that of the second bend.

Figure 2:
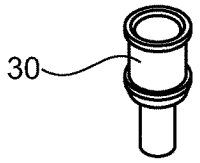
FIG. 2 shows a perspective view of the wiping member on its own.
Figure 3:
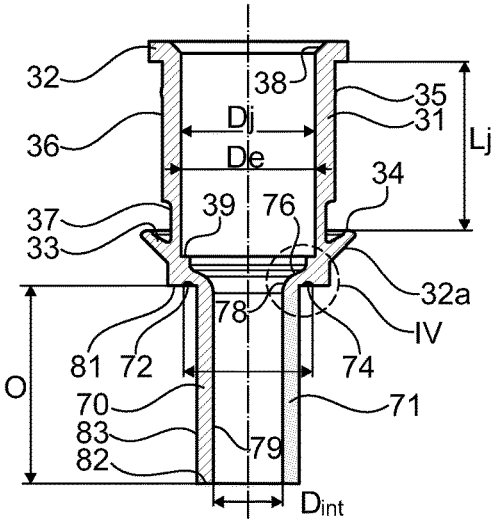
FIG. 3 shows the wiping member on its own, in longitudinal cross section.

If reference is more particularly made to FIGS. 2 and 3, it is seen that the wiping member 30 comprises a mounting skirt 31, which is attached to the neck 12 of the container 10, which is terminated at its upper end by a flange 32 which bears against the edge of the upper end of the neck 12.

The wiping member 30 comprises an attachment flange 33 which is connected to the base of the mounting skirt 31 and which bears against a shoulder 15 formed at the base of the neck 12 by the body 11 of the container.

The flange 33 has at rest, before mounting of the wiping member in the container, a lower face 32*a* of substantially conical shape. A bead 34 is present on the opposite face, over its outer perimeter, being intended to bear against the container.

The mounting skirt 31 may also have, as seen in particular in FIG. 3, an annular bead 35 slightly forming a projection over its radially outer surface 36.

An annular groove 37 may be present above the flange 33 on the surface 36. This groove facilitates the mounting of the wiping member, by enabling the flange 33 to be pushed back against the mounting skirt.

The internal diameter Dj of the mounting skirt 31 may be substantially constant, at least over a length Lj, and between for example 7.3 and 7.6 mm.

The wiping member 30 may have a chamfer 38 at the end flange 32.

The wiping member 30 may have a shoulder 39 at the base of the mounting skirt 31, on the inner surface thereof. The shoulder 39 is useful for the mounting, by bearing on top of it in order to push the wiping member 30 into the neck of the container.

The radially inner edge 60 of the shoulder 39 has a diameter De between 6.5 and 6.7 mm for example.

The mounting skirt 31 is extended below the shoulder 39 by a wiping lip 70 which comprises a tubular part 71 that is connected to the mounting skirt by a narrowed intermediate part 72.

Figure 4:
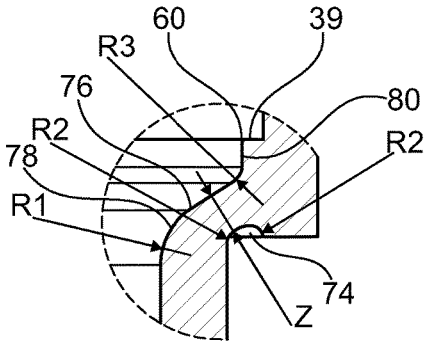
FIG. 4 shows the detail IV from FIG. 3.

It is shown on FIG. 4 that the narrowing of the intermediate part 72 is linked to the presence of a groove 74, opened in the direction of the bottom of the container.

The inner surface 76 of the intermediate part 72 comprises a conical portion that converges in the direction of the bottom of the container, and which is connected by a rounded portion 78 to the inner surface 79, substantially in the form of a cylinder of revolution about the longitudinal axis W of the tubular portion 71.

The radius of curvature R1 of the rounded portion 78 is for example between 0.5 and 3 mm.

The radius of curvature R2 of the groove 74 at its ends is for example between 0.2 and 1 mm.

The radius of curvature R3 by which the conical portion 76 is connected to the side 80 below the shoulder 39 is for example equal to the radius of curvature R2, being for example between 0.2 and 3 mm.

The length O between the lower end 81 of the mounting skirt 31 and the lower end 82 of the tubular portion 70 is for example between 6 and 13 mm and in particular equal to 11 mm or to 8 mm.

The wiping lip may have, along the tubular portion 71, an internal diameter $D_{int}$ that is substantially constant, in particular between 2.5 mm and 6 mm, better still 3.7 mm and 3.9 mm, for example equal to 3.8 mm.

Preferably, the wiping lip 70 has a length k greater than the internal diameter $D_{int}$. The wiping lip 70 preferably has a length k greater than or equal to 6 mm, better still 7 mm.

The radially outer surface 83 of the wiping lip may be located radially set back from the inner surface of the mounting skirt, in particular above the shoulder 39 present at the base of the mounting skirt.

The wiping member 30 may be made from a thermoplastic material, in particular from NBR or nitrile rubber. The wiping member 30 may be moulded in one piece from thermoplastic material.

In order to manufacture the device 1, the wiping member 30 is forcibly inserted into the neck 12 of the container.

When the applicator 20 is removed from the container, the application member 22 crosses the tubular portion 70. The narrowed intermediate part 72 may enable the tubular portion 72 to deform more easily. This deformation may be radial and/or correspond to an inclination of the axis of the tubular portion 70 with respect to the longitudinal axis W of the wiping member at rest.

The wand 21 may also be appropriately wiped, having a diameter substantially equal to or slightly smaller than the internal diameter $D_{int}$ of the wiping lip 70.

The invention is not limited to the examples that have just been described. For example, it is possible to modify the length of the tubular portion or the way in which the wiping member is attached to the container. It is also possible to give other shapes to the wand of the applicator, in particular to modify the number of bends, the position thereof, and the radii of curvature.

The expression "comprising a" is synonymous with "comprising at least one".

The invention claimed is:

1. A device for packaging and applying a product, comprising a container containing the product to be applied and an applicator comprising a wand provided at one end with an application member, an assembly formed by the wand and the application member extending along a non-rectilinear longitudinal axis, and a wiping member borne by the container in order to wipe the wand and the application member when the latter is removed from the container, the wiping member comprising a tubular mounting skirt, in contact with a wall of the container, and a wiping lip comprising a tubular-shaped portion having a length (k) greater than or equal to its internal diameter ($D_{int}$), extending axially beyond the mounting skirt towards the bottom of the container, the wiping lip being connected to the mounting skirt by a narrowed intermediate part, the narrowed intermediate part being delimited on the outer side by an annular groove opened in the direction of the bottom of the container.

2. The device according to claim 1, wherein the wand has a non-rectilinear longitudinal axis.

3. The device according to claim 1, wherein the container comprises a neck in which the mounting skirt is engaged.

4. The device according to claim 1, wherein the wiping lip has, over the tubular portion, an internal diameter ($D_{int}$) that is substantially constant.

5. The device according to claim 4, wherein the internal diameter is between 2.5 mm and 6 mm.

6. The device according to claim 5, wherein the internal diameter is between 3.7 mm and 3.9 mm.

7. The device according to claim 1, wherein the narrowed intermediate part has a minimum thickness (N) of between 0.6 mm and 1 mm.

8. The device according to claim 1, further comprising a shoulder at the base of the mounting skirt, on the inner surface thereof.

9. The device according to claim 8, wherein the radially outer surface of the wiping lip is located radially set back from the surface located above the shoulder present at the base of the mounting skirt.

10. The device according to claim 1, wherein the radially outer surface of the wiping lip is located radially set back from the inner surface of the mounting skirt.

11. The device according to claim 1, wherein the wiping member is made of an elastomer.

12. The device according to claim 11, wherein the wiping member is made of nitrile rubber.

13. The device according to claim 1, wherein the product is a cosmetic product chosen from the group consisting of mascara and a product to be applied to the lips.

14. The device according to claim 1, wherein the wiping member is moulded in one piece from thermoplastic material.

15. The device according to claim 1, wherein the wiping lip is continuous over its entire height.

16. The device according to claim 1, wherein the wiping lip is unchamfered at its lower end.

17. The device according to claim 1, wherein the lower end of the wiping member is defined by the lower end of the wiping lip.

18. A device for packaging and applying a product, comprising a container containing the product to be applied and an applicator comprising a wand provided at one end with an application member, an assembly formed by the wand and the application member extending along a non-rectilinear longitudinal axis, and a wiping member borne by the container in order to wipe the wand and the application member when the application member is removed from the container, the wiping member comprising a tubular mounting skirt, in contact with a wall of the container, and a wiping lip comprising a tubular-shaped portion having a length (k) greater than or equal to its internal diameter ($D_{int}$), extending axially beyond the mounting skirt towards the bottom of the container, the device having a shoulder at the base of the mounting skirt, on the inner surface thereof.

19. The device according to claim 18, wherein the radially outer surface of the wiping lip is located radially set back from the inner surface located above the shoulder.

20. A device for packaging and applying a product, comprising a container containing the product to be applied, an applicator comprising a wand provided at one end with an application member, an assembly formed by the wand and the application member extending along a non-rectilinear longitudinal axis, the wand having a non-rectilinear longitudinal axis, and a wiping member borne by the container in order to wipe the wand and the application member when the application member is removed from the container, the wiping member comprising a tubular mounting skirt, in contact with a wall of the container, and a wiping lip comprising a tubular-shaped portion having a length (k) greater than or equal to its internal diameter ($D_{int}$), extending axially beyond the mounting skirt towards the bottom of the container.

* * * * *